US010621964B1

(12) United States Patent
Boxberger

(10) Patent No.: US 10,621,964 B1
(45) Date of Patent: Apr. 14, 2020

(54) CORDLESS MAGNETIC BOARD APPARATUS THAT TRANSMITS POWER AND SOUND BETWEEN MUSICAL EFFECTS PEDALS

(71) Applicant: Frank Dale Boxberger, Scottsdale, AZ (US)

(72) Inventor: Frank Dale Boxberger, Scottsdale, AZ (US)

( * ) Notice: Subject to any disclaimer, the term of this patent is extended or adjusted under 35 U.S.C. 154(b) by 0 days.

(21) Appl. No.: 16/522,358

(22) Filed: Jul. 25, 2019

Related U.S. Application Data

(60) Provisional application No. 62/711,024, filed on Jul. 27, 2018.

(51) Int. Cl.
*G10H 1/34* (2006.01)

(52) U.S. Cl.
CPC ..... *G10H 1/348* (2013.01); *G10H 2240/211* (2013.01)

(58) Field of Classification Search
CPC ..... G10H 2210/155; G10H 2240/211; G10H 1/32; G10H 1/0555; G10H 2210/235; G10H 2210/311; G10H 2210/265; G10H 2210/315; G10D 13/11; G10G 3/04; G10K 15/08
See application file for complete search history.

(56) References Cited

U.S. PATENT DOCUMENTS

| | | | | |
|---|---|---|---|---|
| 10,192,536 | B1 * | 1/2019 | Jia | G10H 1/0008 |
| 10,380,984 | B1 * | 8/2019 | Calder | G10H 1/32 |
| 10,395,631 | B1 * | 8/2019 | Boxberger | G10H 1/0555 |
| 2007/0295190 | A1 * | 12/2007 | Collins | G10H 1/32 84/422.1 |
| 2011/0271821 | A1 * | 11/2011 | McKinney | G10H 1/348 84/746 |
| 2017/0206879 | A1 * | 7/2017 | Fiden | G10H 1/348 |
| 2018/0204555 | A1 * | 7/2018 | Garcia | G10H 1/348 |
| 2019/0103086 | A1 * | 4/2019 | Christian | H01M 10/482 |

* cited by examiner

*Primary Examiner* — Marlon T Fletcher
(74) *Attorney, Agent, or Firm* — Plager Schack LLP; Mark H. Plager; Eric Liou

(57) ABSTRACT

A cordless magnetic board apparatus for use to transmit power and sound signals between musical effects pedals is provided. The apparatus is connected to a power supply and an input sound source. Each effects pedal includes an input sound connector, an output sound connector and an input power connector. The board apparatus includes a base having a plurality of sets of magnetic members where each set of the magnetic members corresponds to one of the plurality of effects pedals, each set of magnetic members having a first magnetic member corresponding to negative power, a second magnetic member corresponding to positive power, a third magnetic member corresponding to input sound and a fourth magnetic member corresponding to output sound. Musical effects pedals are coupled to the plurality of sets of magnetic members to transmit power and sound between the pedals.

6 Claims, 4 Drawing Sheets

CORDLESS MAGNETIC BOARD APPARATUS THAT TRANSMITS POWER AND SOUND BETWEEN MUSICAL EFFECTS PEDALS

RELATED APPLICATION

The application claims priority to provisional patent application U.S. Ser. No. 62/711,024 filed on Jul. 27, 2018, the entire contents of which is herein incorporated by reference.

BACKGROUND

The embodiments herein relate generally to effects pedals used for musical instruments such as guitars. More specifically, embodiments of the invention are directed to a cordless magnetic board apparatus that transmits power and sound between musical effects pedals.

Effects pedals are well known in the art as devices used by musicians to change some aspect of the sound coming from their musical instrument. The pedals can be moved by the musician's foot to alter the sound that the musical instrument makes.

Currently, devices including effects pedals and musical stringed instruments such as electric guitars and base guitars are often connected together by patch cords with phono plugs to transmit sound signals between the connected devices. During the use of multiple effects pedals and musical instruments at the same time, patch cords often get tangled with each other. This makes the assembly and disassembly of these devices inefficient and a burden. In particular, it takes time to unplug the phono plugs out of the devices and insert phono plugs into the desired devices.

As such, there is a need in the industry for a cordless magnetic board apparatus that addresses the limitations of the prior art, which effectively facilitates sound and power connections between a plurality of musical effects pedals without the use of external power and/or patch cords that create a mess and burden on the user.

SUMMARY

In certain embodiments of the invention, a cordless magnetic board apparatus for use to transmit power and sound signals between a plurality of musical effects pedals thereon is provided. The apparatus is connected to a power supply and an input sound source. Each effects pedal comprises an input sound connector, an output sound connector and an input power connector, The board apparatus comprises a base comprising a plurality of magnetic members secured thereto, the plurality of magnetic members forming a plurality of sets of magnetic members where each set of the magnetic members corresponds to one of the plurality of effects pedals, each set of magnetic members comprising a first magnetic member corresponding to negative power, a second magnetic member corresponding to positive power, a third magnetic member corresponding to input sound and a fourth magnetic member corresponding to output sound, wherein the plurality of sets of magnetic members form a daisy chain connection with the first magnetic members in the plurality of sets of magnetic members electrically coupled together, and the second magnetic members in the plurality of sets of magnetic members electrically coupled together.

In one embodiment, a first set of magnetic members in the plurality of sets of magnetic members is configured to connect to a first effects pedal. The first and second magnetic members of the first set of magnetic members are electrically coupled to the power supply and the power input connector of the first effects pedal, the third magnetic member of the first set of magnetic members is electrically coupled to the input sound source and input sound connector of the first effects pedal, the fourth magnetic member of the first set of magnetic members is electrically coupled to the output sound connector of the first effects pedal.

In certain embodiments, a second set of magnetic members in the plurality of sets of magnetic members is configured to connect to a second effects pedal. The first and second magnetic members of the second set of magnetic members are electrically coupled to the power input connector of the second effects pedal, the third magnetic member of the second set of magnetic members is electrically coupled to the fourth magnetic member of the first set of magnetic members and input sound connector of the second effects pedal, the fourth magnetic member of the second set of magnetic members is electrically coupled to the output sound connector of the second effects pedal.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

In certain embodiments of the invention, a cordless magnetic board apparatus comprises a main base with a plurality of magnetic members that are configured to connect to a plurality of musical effects pedals using a plurality of adapter bases to facilitate the transmission of power and sound signals between the plurality of connected effects pedals. This eliminates the use of external power wires or patch cords to connect the plurality of musical effects pedals together.

Figure 1A:
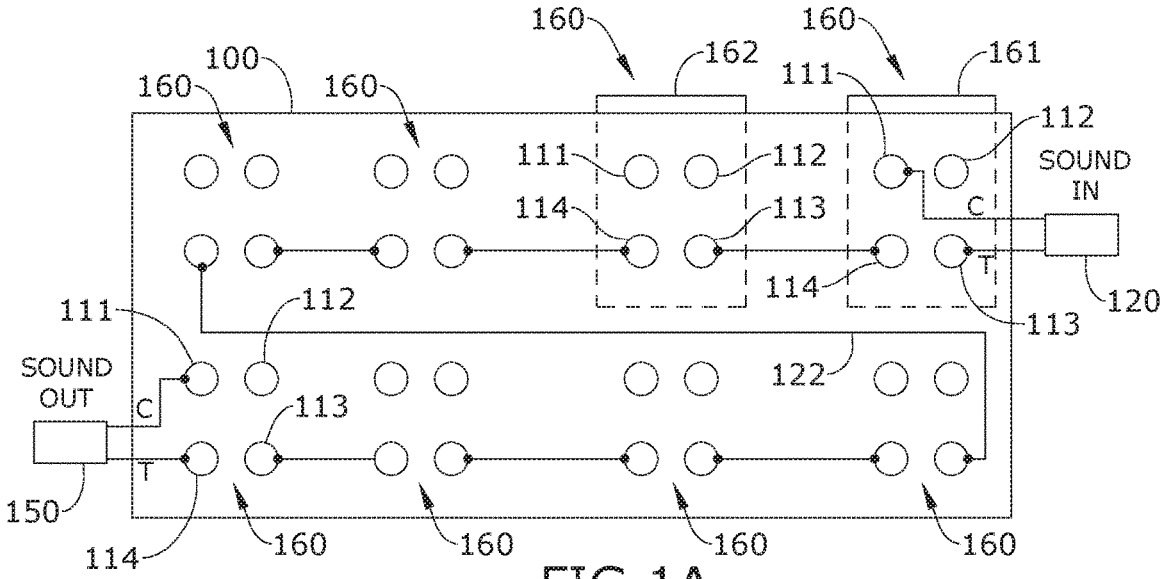
FIG. 1A depicts a schematic view of certain embodiments of the board apparatus illustrating the main base and sound wiring.
Figure 1B:
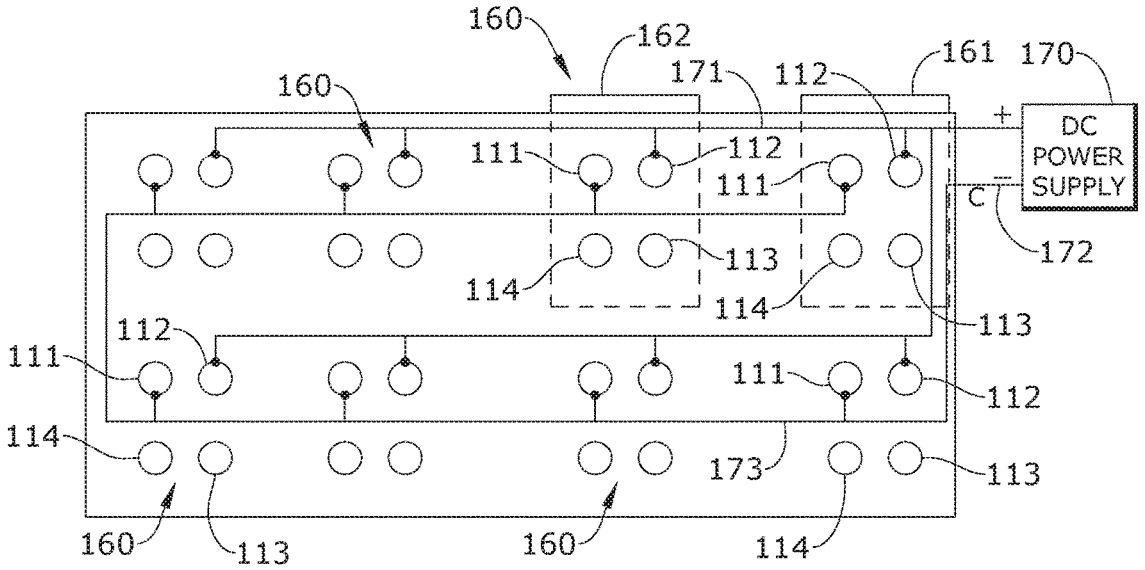
FIG. 1B depicts a schematic view of certain embodiments of the board apparatus illustrating the main base and DC voltage wiring.
Figure 2:
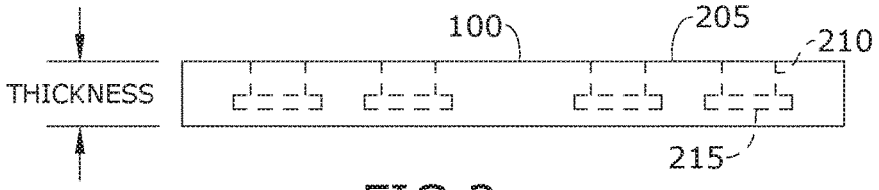
FIG. 2 depicts a side view of certain embodiments of the board apparatus illustrating the main base.

In certain embodiments of the invention as depicted in FIGS. 1-3, the board apparatus comprises main base 100 and a plurality of adapter bases 350. Adapter bases 350 electrically couple the plurality of effects pedals 300 to main base 100.

In one embodiment as depicted in FIG. 2, a side view of main base 100 is illustrated, which comprises a board preferably made from an elastomeric material such as rubber, neoprene or the like, which can be a rigid or flexible material. Main base 100 comprises a plurality of holes 210 that partially extend from top surface 205 to the interior of the base. Bottom portion 215 of each hole 210 is configured to secure a magnetic member therein. In one embodiment, main base 100 comprises a thickness of approximately ¼"-1½". However, the dimensions of main base 100 including the thickness can vary.

Figure 4:
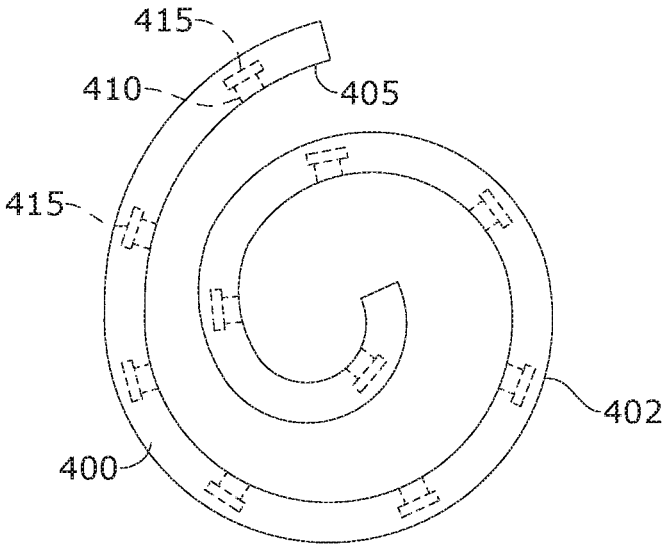
FIG. 4 depicts a side view of an alternative embodiment of the board apparatus illustrating the main base.

In an alternative embodiment as depicted in FIG. 4, alternate main base 400 is illustrated, which is the same as main base 100, but made using a flexible material such as rubber that can roll up. Alternate main base 400 comprises bottom surface 402 configured to contact a base surface, top surface 405, a plurality of holes 410 with bottom portions 415. Bottom portion 415 of each hole 410 is configured to secure a magnetic member therein.

In certain embodiments as depicted in FIGS. 1A-1B, main base 100 is depicted with a plurality of the magnetic members secured thereto. The magnetic members are organized along main base 100 to form a plurality of sets 160 of magnetic members including first set 161 of magnetic members, second set 162 of magnetic members and so forth up to eight sets of magnetic members. Although the figures depict eight sets of magnetic members on main base 100, it shall be appreciated that any alternative number of sets of magnetic members can be used on main base 100 instead.

Each set 160 of magnetic members comprises first magnetic member 111 corresponding to negative (–) power, ground, and the common line for DC power, input and output sound, second magnetic member 112 corresponding to positive (+) power, third magnetic member 113 corresponding to input sound, and fourth magnetic member 114 corresponding to output sound. Each magnetic member 111, 112, 113, 114 is made from steel or another magnetic material.

Magnetic members 111, 112, 113, 114 of sets 160 of magnetic members are electrically coupled together by wires on main base 100 to form a daisy chain connection for power and sound. In one embodiment as depicted in FIG. 1A, the sound wiring connections are illustrated on main base 100. In this embodiment, input sound connector 120, such as a ¼" phono connector coupled to an input sound source such as a guitar or other musical instrument, is electrically coupled to main base 100. Specifically, the tip of input sound connector 120 is electrically coupled to third magnetic member 113 of first set 161 of magnetic members on main base 100, which corresponds to input sound for a first effects pedal. The common sound line of input sound connector 120 is electrically coupled to first magnetic member 111 of first set 161 of magnetic members on main base 100.

Fourth magnetic member 114 in first set 161 of magnetic members corresponding to output sound of a first effects pedal is electrically coupled to third magnetic member 113 of second set 162 of magnetic members on main base 100, which corresponds to input sound for a second effects pedal. Fourth magnetic member 114 in second set 162 of magnetic members corresponding to output sound of a second effects pedal is electrically coupled to third magnetic member 113 of a third set of magnetic members on main base 100, which corresponds to input sound for a third effects pedal. This same sequential connection is repeated up to the eighth set of magnetic members, which is connected to output sound connector 150, such as a phono connector coupled to an output device such as an amplifier or speaker. In this connection, fourth magnetic member 114 in the eighth set of magnetic members is electrically coupled to the tip of output sound connector 150.

In one embodiment as depicted in FIG. 1B, the DC voltage wiring connections are illustrated on main base 100. In this embodiment, a power supply such as DC power supply 170 is electrically coupled to first and second magnetic members 111, 112 in first set 161 of magnetic members. Specifically, positive power of DC power supply 170 is electrically coupled to second magnetic member 112 in first set 161 and negative power output 172 of DC power supply 170 is electrically coupled to first magnetic member 111 in first set 161. The plurality of first magnetic members 111 of all sets 160 of magnetic members are electrically coupled together by negative power line 173. The plurality of second magnetic members 112 of all sets 160 of magnetic members are electrically coupled together by positive power line 171.

In this configuration, a plurality of effects pedals are coupled to main base 100 with each effects pedal electrically coupled to one set 160 of magnetic members to transmit power and sound between the plurality of effects pedals. In certain embodiments as depicted in FIG. 3, each effects pedal 300 is electrically coupled to one set 160 of magnetic members on main base 100 by adapter base 350.

Figure 3A:
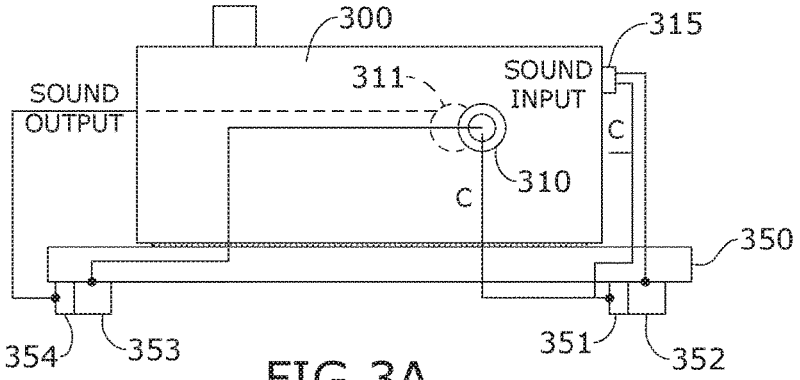
FIG. 3A depicts a side view of certain embodiments of the board apparatus illustrating the connection of the effects pedal with the adapter base.
Figure 3B:
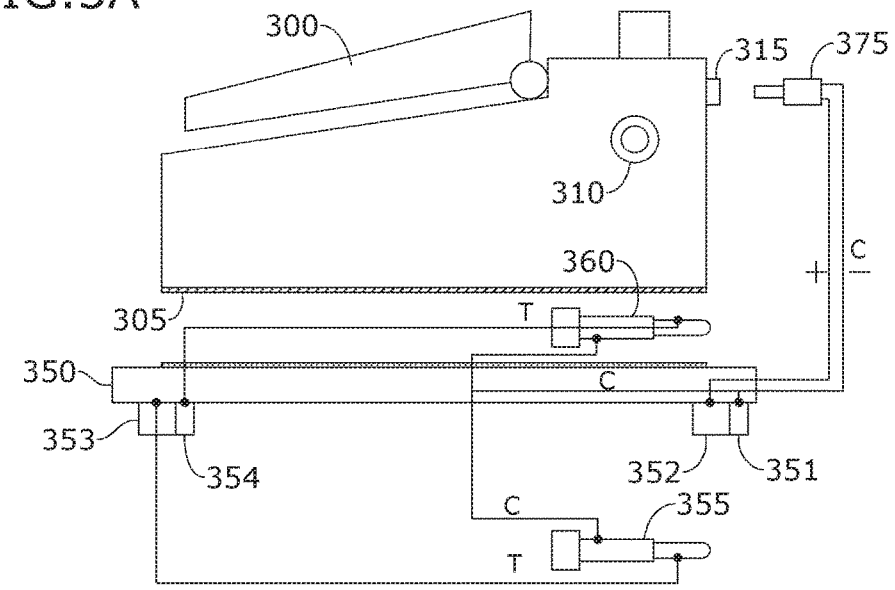
FIG. 3B depicts a side view of certain embodiments of the board apparatus illustrating the connection of the effects pedal with the adapter base.

In certain embodiments as depicted in FIGS. 3A-3B, each effects pedal 300 comprises input sound connector 310, output sound connector 311 and input power connector 315. Effects pedal 300 may be any type of effects pedal known in the field including, but not limited to, a fuzz box, a wawa pedal or other type of pedal. As depicted in FIGS. 3A-3B, each effects pedal 300 is coupled to adapter base 300 mechanically and electrically. In one embodiment, effects pedal 300 is coupled to the top of adapter base 350 by fastener 305, which may be hook and loop fasteners, snap fasteners or other fastening components.

Figure 3C:
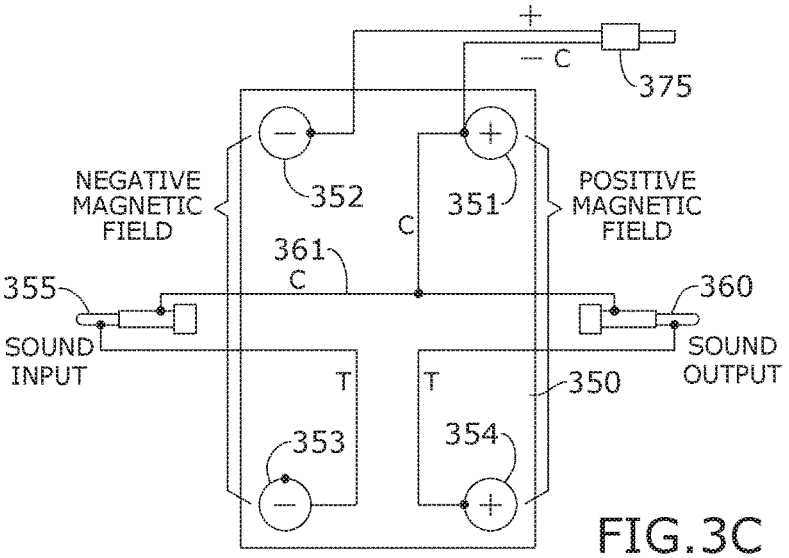
FIG. 3C depicts a bottom view of certain embodiments of the board apparatus illustrating the adapter base.

In one embodiment of the invention best shown in FIG. 3C, the bottom of adapter base 350 comprises first magnet 351 corresponding to negative power, second magnet 352 corresponding to positive power, third magnet 353 corresponding to input sound and fourth magnet 354 corresponding to output sound. Each of the magnets 351, 352, 353, 354 can be made from rare earth magnets such as neodymium magnets.

Figure 3D:
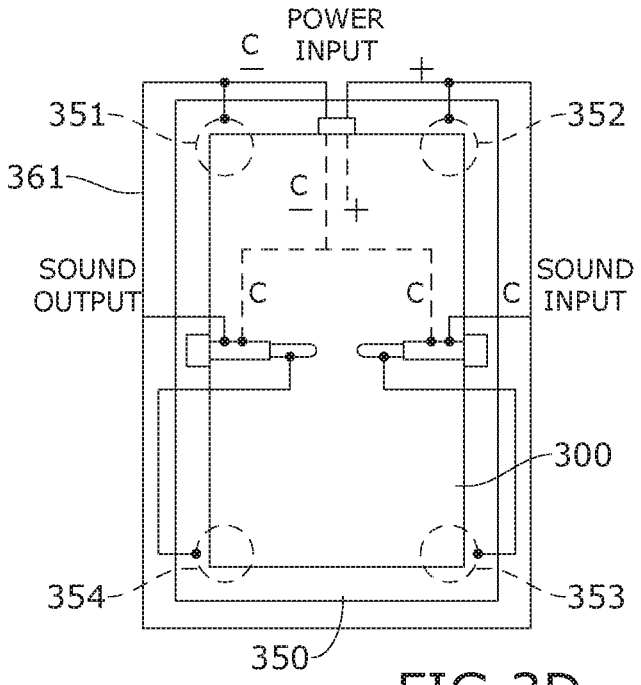
FIG. 3D depicts a top view of certain embodiments of the board apparatus illustrating the connection of the effects pedal to the adapter base.

In one embodiment as depicted in FIGS. 3A-3D, each effects pedal 300 is electrically coupled to adapter base 350 by connectors and wires. Specifically, power connector 375 is electrically coupled to input power connector 315 on effects pedal 300. Power connector 375 is electrically coupled to first magnet 351 for negative power and second magnet 352 for positive power. Input sound connector 355 is coupled to input sound connector 310 on effects pedal 300 and electrically coupled to third magnet 353 on adapter base 350. Output sound connector 360 is coupled to output sound connector 311 on effects pedal 300 and electrically coupled to fourth magnet 354 on adapter base 350. Wire 361 is "common" to power connector 375, input sound connector 355 and output sound connector 360, and is electrically coupled to first magnet 351 of adapter base 350. FIG. 3D illustrates a top view of effects pedal 300 and adapter base 350 with the power and sound connections.

In operation in an embodiment with the power and sound connections previously described, eight effects pedals 300 are coupled to the plurality of sets 160 of magnetic members on main base 100. Each pair of connected effects pedal 300 and adapter base 150 is electrically coupled to one set 160 of magnetic members on main base 100. In one embodiment, first effects pedal 300 and first adapter base 350 are disposed on first set 161 of magnetic members so that first magnet 351 of adapter base 350 engages with first magnetic member 111 to establish a negative power connection, second magnet 352 of adapter base 350 engages with second magnetic member 112 to establish a positive power connection, third magnet 353 of adapter base 350 engages with third magnetic member 113 to establish an input sound connection, and fourth magnet 354 of adapter base 350 engages with fourth magnetic member 114 to establish an output sound connection.

Each of the remaining connected pairs of effects pedal 300 and adapter base 150 are electrically coupled to the remaining sets 160 of magnetic members (second set to the eighth set of magnetic members) in the same manner. Each of the eight effects pedals 300 is powered through its respective connected adapter base 350 via the electrical connection with first and second magnetic members 111, 112 of the corresponding set, which is electrically coupled to DC power supply 170.

Input sound is transferred from a source such as a guitar to first effects pedal 300 through input sound connector 120. This input sound is transmitted to the first effects pedal through third magnetic member 113 in first set 161 of magnetic members, third magnet 353 in first adapter base 350 and input sound connector 310 of first effects pedal 300. The input sound is altered by first effects pedal 300 and transmitted as output altered sound through output sound connector 311 of first effects pedal 300, fourth magnet 354 in first adapter base 350 and fourth magnetic member 114 in first set 161 of magnetic members.

The output altered sound from first effects pedal 300 is transmitted from fourth magnetic member 114 in first set 161 of magnetic members to second effects pedal 300 through third magnetic member 113 in second set 162 of magnetic members, third magnet 353 in second adapter base 350 and input sound connector 310 of second effects pedal 300. Second effects pedal 300 further alters the sound from first effects pedal 300 and transmits the altered sound to third effects pedal 300 in the same manner previously described. The transmitted sound is altered through the remaining, fourth, fifth, sixth, seventh and eighth effects pedals. The final altered sound through all eight effects pedals is transmitted through output sound connector 150 to an amplifier or speaker.

In an alternative embodiment, a user can connect fewer effects pedals 300 to main base 100. In this embodiment, effects pedals 300 are connected to main base 100 in sequence as described in embodiments of the invention. An insert is electrically coupled to main base 100 to short circuit the components and circuit pertaining to the unused portions of main base 100 to allow the final altered sound of the last effects pedal 300 in sequence to be transmitted through output sound connector 150.

Figure 5:
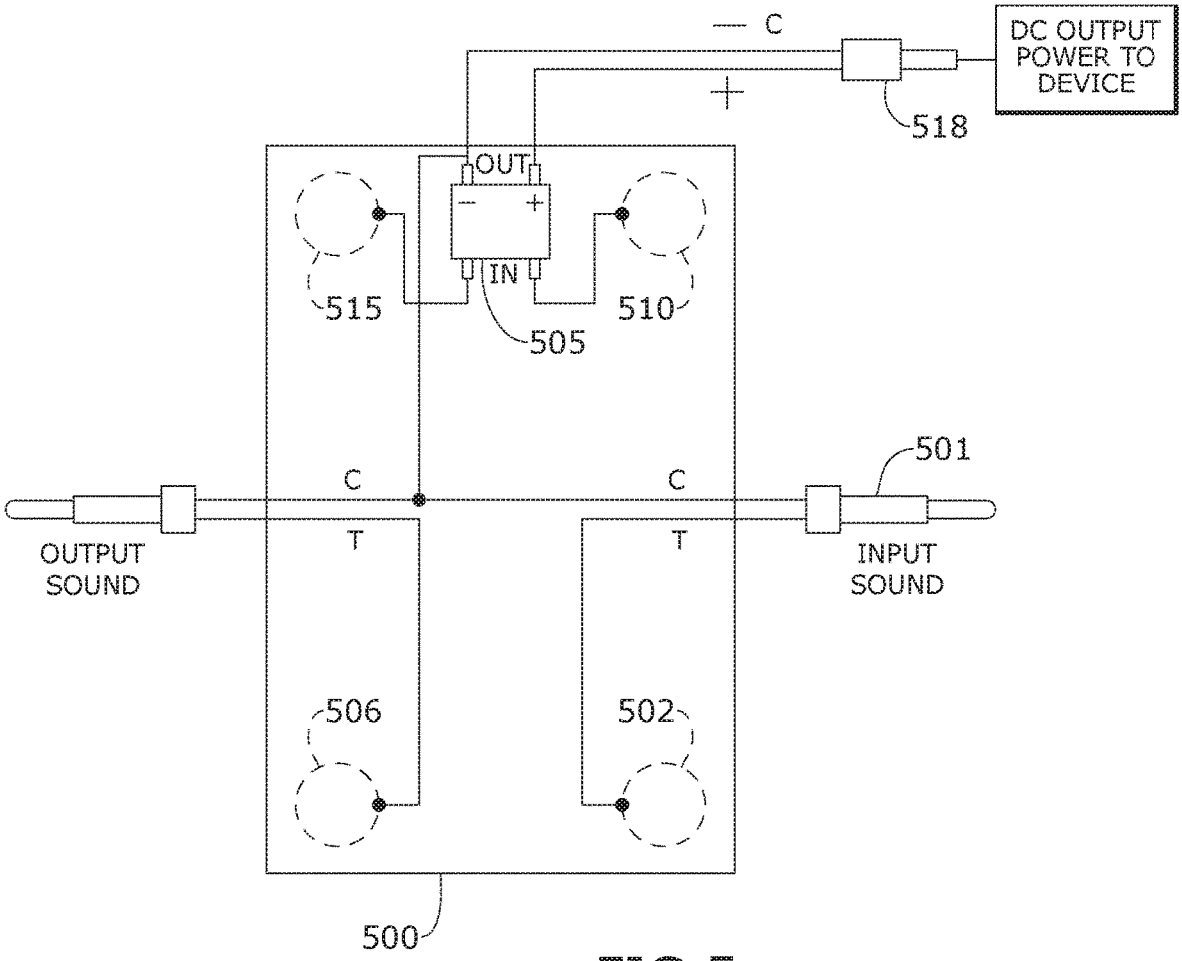
FIG. 5 depicts a top view of an alternative embodiment of the board apparatus illustrating the adapter base.

In an alternative embodiment as depicted in FIG. 5, adapter base 500 includes bridge rectifier 505, which prevents any damage from improper polarity in connecting the power supply. As in the other embodiments, each of magnets 502, 506, 510, 515 are metal contacts with rare earth magnets for attracting other contacts. Magnet 502 sends input sound via plug 501 to the effects pedal. Magnet 506 receives the output sound from the effects pedal. DC power is received between magnets 510, 515, and rectified by bridge rectifier 505. By use of the bridge rectifier, the wiring among the points can be simplified, since each of the daisy chained connections can be sent to two adjacent points since the polarity of the power supply can be reversed without causing any damage.

It shall be appreciated that the components of the magnetic board apparatus described in several embodiments herein may comprise any alternative known materials in the field and be of any color, size and/or dimensions. It shall be appreciated that the components of the magnetic board apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A cordless magnetic board apparatus for use to transmit power and sound signals between a plurality of musical effects pedals thereon, the apparatus connected to a power supply and an input sound source, each effects pedal in the plurality of effects pedals comprising an input sound connector, an output sound connector and an input power connector, the board apparatus comprising:

a base comprising a plurality of magnetic members secured thereto, the plurality of magnetic members forming a plurality of sets of magnetic members where each set of the magnetic members in the plurality of sets of magnetic members corresponds to one of the plurality of effects pedals, each set of magnetic members in the plurality of sets of magnetic members comprising a first magnetic member corresponding to negative power, a second magnetic member corresponding to positive power, a third magnetic member corresponding to input sound and a fourth magnetic member corresponding to output sound, wherein the plurality of sets of magnetic members form a daisy chain connection with the first magnetic members in the plurality of sets of magnetic members electrically coupled together, and the second magnetic members in the plurality of sets of magnetic members electrically coupled together;

wherein a first set of magnetic members in the plurality of sets of magnetic members is configured to connect to a first effects pedal in the plurality of effects pedals, the first and second magnetic members of the first set of magnetic members electrically coupled to the power supply and the power input connector of the first effects pedal, the third magnetic member of the first set of magnetic members electrically coupled to the input sound source and input sound connector of the first effects pedal, the fourth magnetic member of the first set of magnetic members electrically coupled to the output sound connector of the first effects pedal;

wherein a second set of magnetic members in the plurality of sets of magnetic members is configured to connect to a second effects pedal in the plurality of effects pedals, the first and second magnetic members of the second set of magnetic members electrically coupled to the power input connector of the second effects pedal, the third magnetic member of the second set of magnetic members electrically coupled to the fourth magnetic member of the first set of magnetic members and input sound connector of the second effects pedal, the fourth magnetic member of the second set of magnetic members electrically coupled to the output sound connector of the second effects pedal.

2. The cordless magnetic board apparatus of claim 1, further comprising a plurality of adapter bases electrically coupled to the plurality of magnetic members of the base, each adapter base in the plurality of adapter bases corresponding to one of the plurality of effects pedals and one of the plurality of sets of magnetic members on the base, each adapter base comprising a plurality of magnets coupled thereto comprising a first magnet corresponding to negative power, a second magnet corresponding to positive power, a third magnet corresponding to input sound and a fourth magnet corresponding to output sound.

3. The cordless magnetic board apparatus of claim 2, wherein the plurality of adapter bases comprises a first adapter base, the first and second magnets of the first adapter base electrically coupled to the first and second magnetic members of the first set of magnetic members and input power connector of the first effects pedal, the third magnet of the first adapter base electrically coupled to the third magnetic member of the first set of magnetic members on the base and input sound connector of the first effects pedal, the fourth magnet of the first adapter base electrically coupled to the fourth magnetic member of the first set of magnetic members on the base and output sound connector of the first effects pedal.

4. The cordless magnetic board apparatus of claim 3, wherein the plurality of adapter bases comprises a second adapter base, the first and second magnets of the second adapter base electrically coupled to the first and second magnetic members of the second set of magnetic members and input power connector of the second effects pedal, the third magnet of the second adapter base electrically coupled to the third magnetic member of the second set of magnetic members on the base and input sound connector of the second effects pedal, the fourth magnet of the second adapter base electrically coupled to the fourth magnetic member of the second set of magnetic members on the base and output sound connector of the second effects pedal.

5. The cordless magnetic board apparatus of claim 4, wherein the first adapter base is coupled to the first effects pedal by a first fastener and the second adapter base is coupled to the second effects pedal by a second fastener.

6. The cordless magnetic board apparatus of claim 5, wherein the base comprises a top surface and a bottom surface, the top surface comprising a plurality of holes that partially extend into the base, the plurality of holes of the base housing the plurality of magnetic members therein.

* * * * *